US010408473B2

(12) United States Patent
Ostrye et al.

(10) Patent No.: US 10,408,473 B2
(45) Date of Patent: Sep. 10, 2019

(54) METHOD FOR SEQUENCING COMPRESSOR OPERATION BASED ON SPACE HUMIDITY

(71) Applicant: Johnson Controls Technology Company, Plymouth, MI (US)

(72) Inventors: Nathan T. Ostrye, Milwaukee, WI (US); Aron Marc Seiler, White Hall, MD (US); Christopher R. Amundson, Grafton, WI (US); Tyler Paddock, Greenfield, WI (US)

(73) Assignee: Johnson Controls Technology Company, Auburn Hills, MI (US)

( * ) Notice: Subject to any disclaimer, the term of this patent is extended or adjusted under 35 U.S.C. 154(b) by 88 days.

(21) Appl. No.: 15/617,931

(22) Filed: Jun. 8, 2017

(65) Prior Publication Data

US 2018/0094824 A1 Apr. 5, 2018

Related U.S. Application Data

(60) Provisional application No. 62/404,663, filed on Oct. 5, 2016.

(51) Int. Cl.

| | |
|---|---|
| ***F24F 11/30*** | (2018.01) |
| ***F24F 3/153*** | (2006.01) |
| ***F24F 3/14*** | (2006.01) |
| ***F24F 11/83*** | (2018.01) |
| *F24F 11/85* | (2018.01) |
| *F24F 110/20* | (2018.01) |
| *F24F 11/84* | (2018.01) |

(52) U.S. Cl.

CPC ..... *F24F 3/153* (2013.01); *F24F 3/1405* (2013.01); *F24F 11/30* (2018.01); *F24F 11/83* (2018.01); *F24F 11/84* (2018.01); *F24F 11/85* (2018.01); *F24F 2110/20* (2018.01)

(58) Field of Classification Search

CPC .. F24F 11/30; F24F 11/83; F24F 11/84; F24F 11/85; F24F 2110/20; F24F 3/1405; F24F 3/153

USPC ..... 62/228.1

See application file for complete search history.

(56) References Cited

U.S. PATENT DOCUMENTS

| | | | |
|---|---|---|---|
| 4,829,779 | A | 5/1989 | Munson et al. |
| 6,185,946 | B1 | 2/2001 | Hartman |
| 6,427,454 | B1 | 8/2002 | West |

(Continued)

*Primary Examiner* — Filip Zec

(74) *Attorney, Agent, or Firm* — Fletcher Yoder, P.C.

(57) ABSTRACT

A multi-circuit refrigeration system includes a first plurality of compressors, a second plurality of compressors, and a control panel. The control panel is configured to receive an input related to humidity from a humidity sensor or humidistat. Based on the input, the control panel is configured to sequence operation of the first plurality of compressors and the second plurality of compressors between a balanced mode and a clustered mode. In the balanced mode, a first compressor of the first plurality of compressors and a first compressor of second plurality of compressors are energized before a second compressor of the first plurality of compressors or a second compressor of the second plurality of compressors is energized. In the clustered mode, the first compressor and the second compressor of the first plurality of compressors are energized before the first compressor or the second compressor of the second plurality of compressors is energized.

19 Claims, 11 Drawing Sheets

(56) References Cited

U.S. PATENT DOCUMENTS

| | | | | |
|---|---|---|---|---|
| 7,287,395 | B2 | 10/2007 | Nash, Jr. | |
| 8,397,522 | B2 | 3/2013 | Springer et al. | |
| 9,080,798 | B2 | 7/2015 | Shapiro et al. | |
| 2015/0293505 | A1* | 10/2015 | Acosta Gonzalez | F04D 27/00 700/29 |
| 2015/0370271 | A1* | 12/2015 | Raghunathan | F24F 11/62 700/277 |
| 2016/0143181 | A1 | 5/2016 | De Felice et al. | |
| 2016/0187896 | A1* | 6/2016 | Jones | H04L 12/2816 700/276 |

* cited by examiner

METHOD FOR SEQUENCING COMPRESSOR OPERATION BASED ON SPACE HUMIDITY

CROSS REFERENCE TO RELATED APPLICATIONS

This application claims priority from and the benefit of U.S. Provisional Patent Application No. 62/404,663, entitled METHOD FOR SEQUENCING COMPRESSOR OPERATION BASED ON SPACE HUMIDITY, filed Oct. 5, 2016, which is hereby incorporated by reference.

BACKGROUND

The present disclosure relates generally to heating, ventilating, and air conditioning systems (HVAC), and more particularly to sequencing compressors of HVAC systems based on space humidity.

A wide range of applications exists for HVAC systems. For example, residential, light commercial, commercial, and industrial systems are used to control temperatures and air quality in residences and buildings. Generally, HVAC systems may circulate a fluid, such as a refrigerant, through a closed loop between an evaporator where the fluid absorbs heat and a condenser where the fluid releases heat. The fluid flowing within the closed loop is generally formulated to undergo phase changes within the normal operating temperatures and pressures of the system so that quantities of heat can be exchanged by virtue of the latent heat of vaporization of the fluid.

HVAC units, such as air handlers, heat pumps, and air conditioning units, are used to provide heated, cooled, and/or dehumidified air to conditioned environments. Depending on the type of air desired, compressors of the HVAC units may be selectively energized. However, in certain applications, the compressors may not be optimally sequenced. Accordingly, it may be desirable to sequence energization of the compressors of the HVAC system more efficiently.

SUMMARY

In one embodiment of the present disclosure, a multi-circuit refrigeration system includes a first refrigeration circuit having a first plurality of compressors. Each compressor of the first plurality of compressors is configured to compress a first gaseous refrigerant into a first compressed refrigerant. The multi-circuit refrigeration system also includes a second refrigeration circuit independent of the first refrigeration circuit having a second plurality of compressors. Each compressor of the second plurality of compressors is configured to compress a second gaseous refrigerant into a second compressed refrigerant. The multi-circuit refrigeration system further includes a control panel configured to receive an input related to humidity from a humidity sensor or humidistat. Additionally, the control panel is configured to, based on the input, sequence operation of the first plurality of compressors and the second plurality of compressors between a balanced mode and a clustered mode. In the balanced mode, a first compressor of the first plurality of compressors and a first compressor of the second plurality of compressors are energized before a second compressor of the first plurality of compressors or a second compressor of the second plurality of compressors is energized. Moreover, in the clustered mode, the first compressor and the second compressor of the first plurality of compressors are energized before the first compressor or the second compressor of the second plurality of compressors is energized.

In another embodiment of the present disclosure, a method for operating compressors of a multi-circuit refrigeration system includes receiving an input related to humidity from a humidity sensor or humidistat. The method also includes, based on the input, sequencing operation of a first plurality of compressors of a first refrigeration circuit and a second plurality of compressors of a second refrigeration circuit between a balanced mode and a clustered mode. Sequencing compressors in the balanced mode includes energizing a first compressor of the first plurality of compressors and a first compressor of the second plurality of compressors before energizing a second compressor of the first plurality of compressors or a second compressor of the second plurality of compressors. Additionally, sequencing compressors in the clustered mode includes energizing the first compressor and the second compressor of the first plurality of compressors before energizing the first compressor or the second compressor of the second plurality of compressors.

In a further embodiment of the present disclosure, one or more tangible, non-transitory machine-readable media include processor-executable instructions to receive one or more inputs related to humidity from a humidity sensor or humidistat. The one or more tangible, non-transitory machine-readable media include processor-executable instructions to, based on the input, sequence operation of a first plurality of compressors of a first refrigeration circuit and a second plurality of compressors of a second refrigeration circuit between a balanced mode and a clustered mode. In the balanced mode, a first compressor of the first plurality of compressors and a first compressor of second plurality of compressors are energized before a second compressor of the first plurality of compressors or a second compressor of the second plurality of compressors is energized. Additionally, in the clustered mode, the first compressor and the second compressor of the first plurality of compressors are energized before the first compressor or the second compressor of the second plurality of compressors is energized.

Other features and advantages of the present application will be apparent from the following, more detailed description of the embodiments, taken in conjunction with the accompanying drawings which illustrate, by way of example, the principles of the application.

DRAWINGS

DETAILED DESCRIPTION

Figure 1:
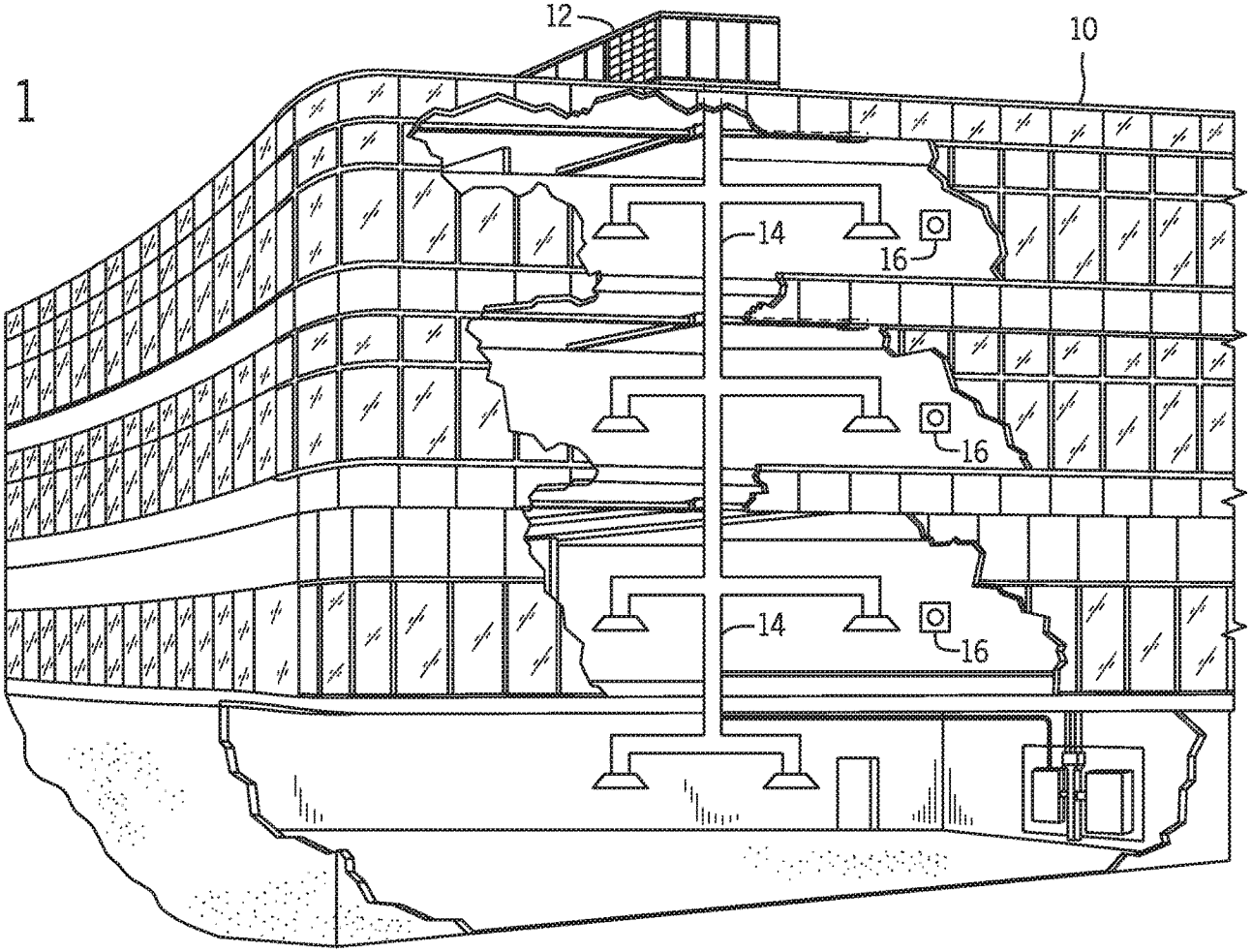
FIG. 1 is an illustration of an embodiment of a commercial or industrial HVAC system, in accordance with the present techniques.

The present disclosure is directed to a multi-circuit HVAC system (e.g., multi-circuit refrigeration system) that optimally sequences operation of compressors of the HVAC system to provide conditioned return air. In some embodiments, the HVAC system may also include a hot gas reheat (HGRH) system for dehumidification of the return air. The HVAC system is designed to sequence operation of the compressors between two operating modes: a balanced compressor mode (e.g., balanced mode) and a clustered compressor mode (e.g., clustered mode). A control panel may energize (e.g., activate) the compressors in the order the compressors are sequenced. In general, the sequencing described herein may permit the compressors to be optimally energized in a certain order to improve operation of the HVAC system. For example, the control panel may receive a conditioning request that return air from the HVAC system be cooled, dehumidified, or a combination thereof, and the control panel may sequence compressor operation based on the request.

Certain compressor modes may be more efficient for certain conditioning requests. For example, to provide cooling without dehumidification, the HVAC system may operate in the balanced compressor mode. To provide dehumidification without cooling or dehumidification with cooling, the HVAC system may operate in the clustered compressor mode. In the clustered compressor mode, the control panel of the HVAC system sequences each compressor of a first refrigeration circuit before sequencing compressors of a second refrigeration circuit. The clustered compressor mode can therefore apply more energy-efficient dehumidification by achieving a higher refrigerant flowrate in one refrigerant circuit. In the balanced compressor mode, the control panel sequences one compressor of each of the first and the second refrigeration circuits before sequencing an additional compressor of either refrigeration circuit. The balanced compressor mode can therefore apply more energy-efficient cooling by using two refrigeration circuits to cool the return air. If a HGRH system is included in the HVAC system and dehumidification (with or without cooling) is requested, the control panel selects the clustered compressor mode and initially energizes the compressor and/or refrigeration circuit having the HGRH system. If a greater cooling capacity of the HVAC system is desired, the control panel energizes the compressor that is sequenced next, in accordance with the current operating mode.

As discussed below, the compressor sequencing may also account for a start count of each compressor, an operational run time of each compressor, a status of each compressor, and/or a capacity of each compressor, among other compressor operation parameters. Further, the compressor sequencing may allow for selection between a smooth transition mode and a rapid transition mode for transitioning between the clustered compressor mode and the balanced compressor mode during operation. Accordingly, compressor sequencing, as described herein, may be optimized to increase efficiency and reduce costs of the HVAC system, while maintaining return air within desired temperature and humidity values.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
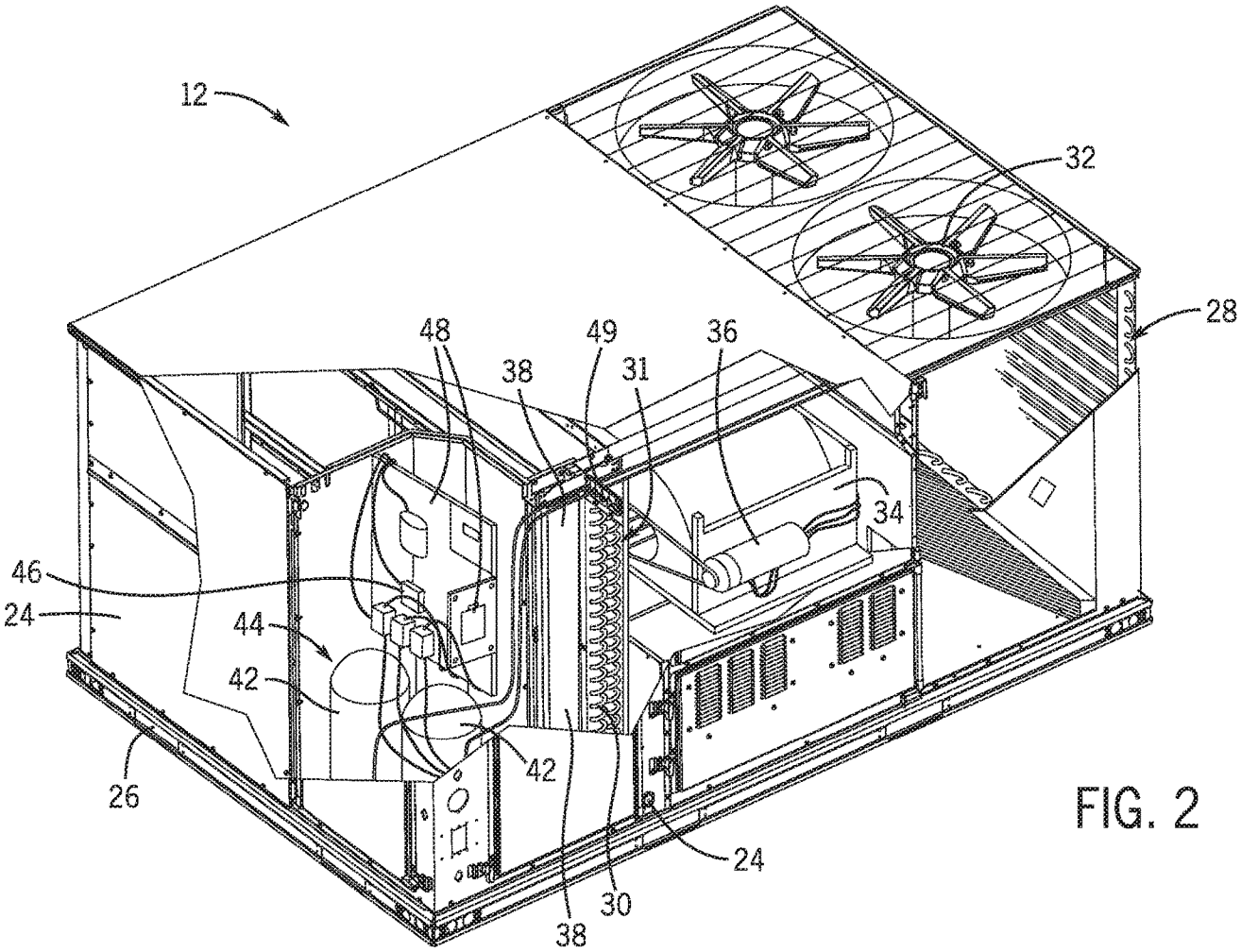
FIG. 2 is an illustration of an embodiment of a packaged unit of the HVAC system shown in FIG. 1, in accordance with the present techniques.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
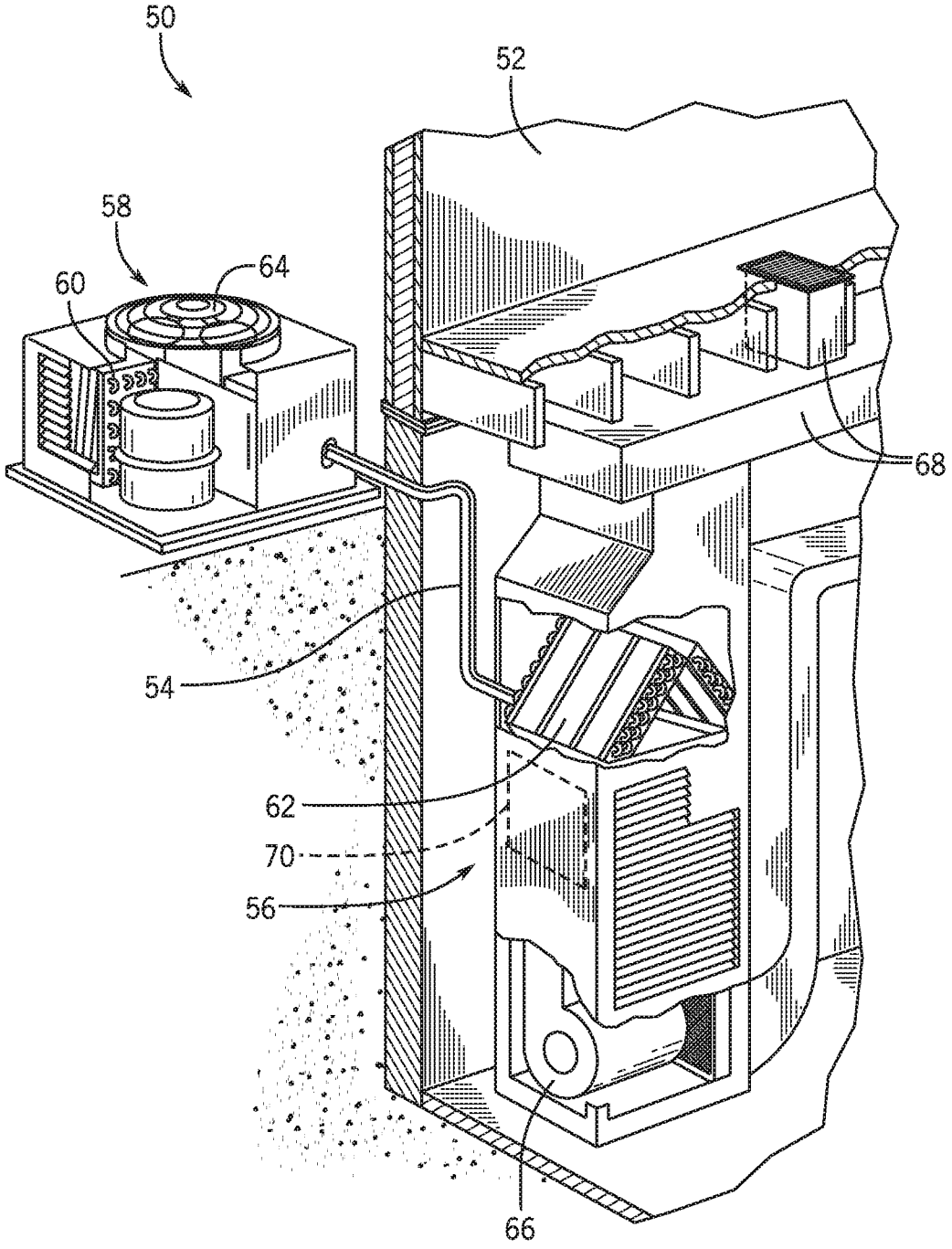
FIG. 3 is an illustration of an embodiment of a split system of the HVAC system shown in FIG. 1, in accordance with the present techniques.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
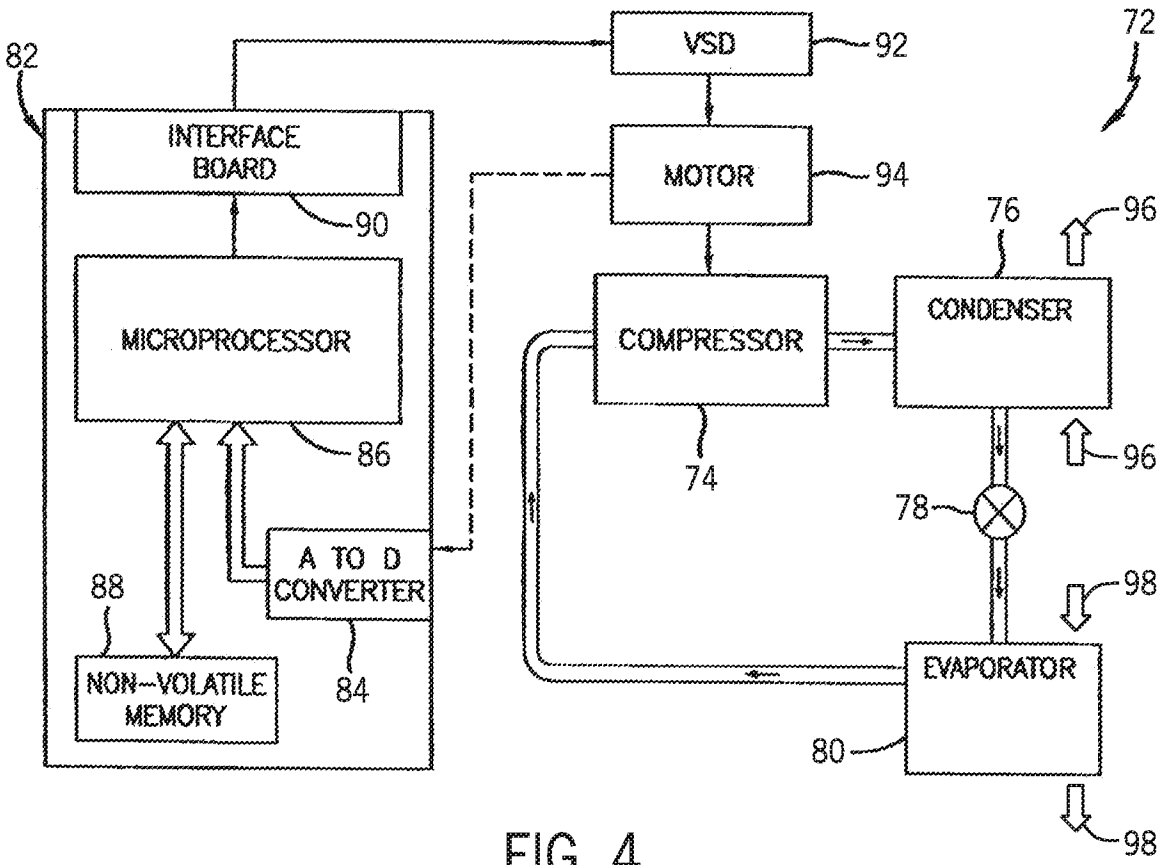
FIG. 4 is a schematic diagram of an embodiment of a refrigeration system of the HVAC system shown in FIG. 1, in accordance with the present techniques.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, compressors of the HVAC unit 12 may be sequenced in various compressor modes to provide more efficient conditioning of interior spaces. These compressors may include the compressors 42 of FIG. 2 and/or the compressor 76 of FIG. 4. In some embodiments, the compressor sequencing techniques discussed herein quickly meet cooling demand while reducing any potential conditioning overshoot as an actual temperature and/or humidity approaches a desired temperature and/or humidity. For example, to provide cooling without dehumidification, the HVAC system may operate in a balanced compressor mode. A control panel operating the compressors in the balanced compressor mode will load all refrigeration circuits as evenly as possible. That is, in the balanced compressor mode, the control panel sequences one compressor of each of the first and the second refrigeration circuits before sequencing an additional compressor of either refrigeration circuit, such that nearly equal numbers of compressors are operating on each circuit.

To provide dehumidification, the HVAC system may operate in the clustered compressor mode. If a HGRH system is included in the HVAC system and dehumidification (with or without cooling) is requested, the control panel operates in the clustered compressor mode and initially energizes the compressor and/or refrigeration circuit having the HGRH system. A control panel operating the compressors in the clustered compressor mode will load one refrigeration circuit completely before loading another refrigeration circuit. That is, in the clustered compressor mode, the control panel of the HVAC system sequences each compressor of a first refrigeration circuit before sequencing compressors of a second refrigeration circuit. The clustered compressor mode can therefore apply more energy-efficient dehumidification by achieving a higher refrigerant flowrate in one refrigerant circuit. It is to be understood the compressor sequencing techniques discussed herein also apply to turning off compressors, such that as any requested cooling and dehumidification loads are met, the compressors are also shut down or unloaded in accordance with selected compressor mode.

Figure 5:
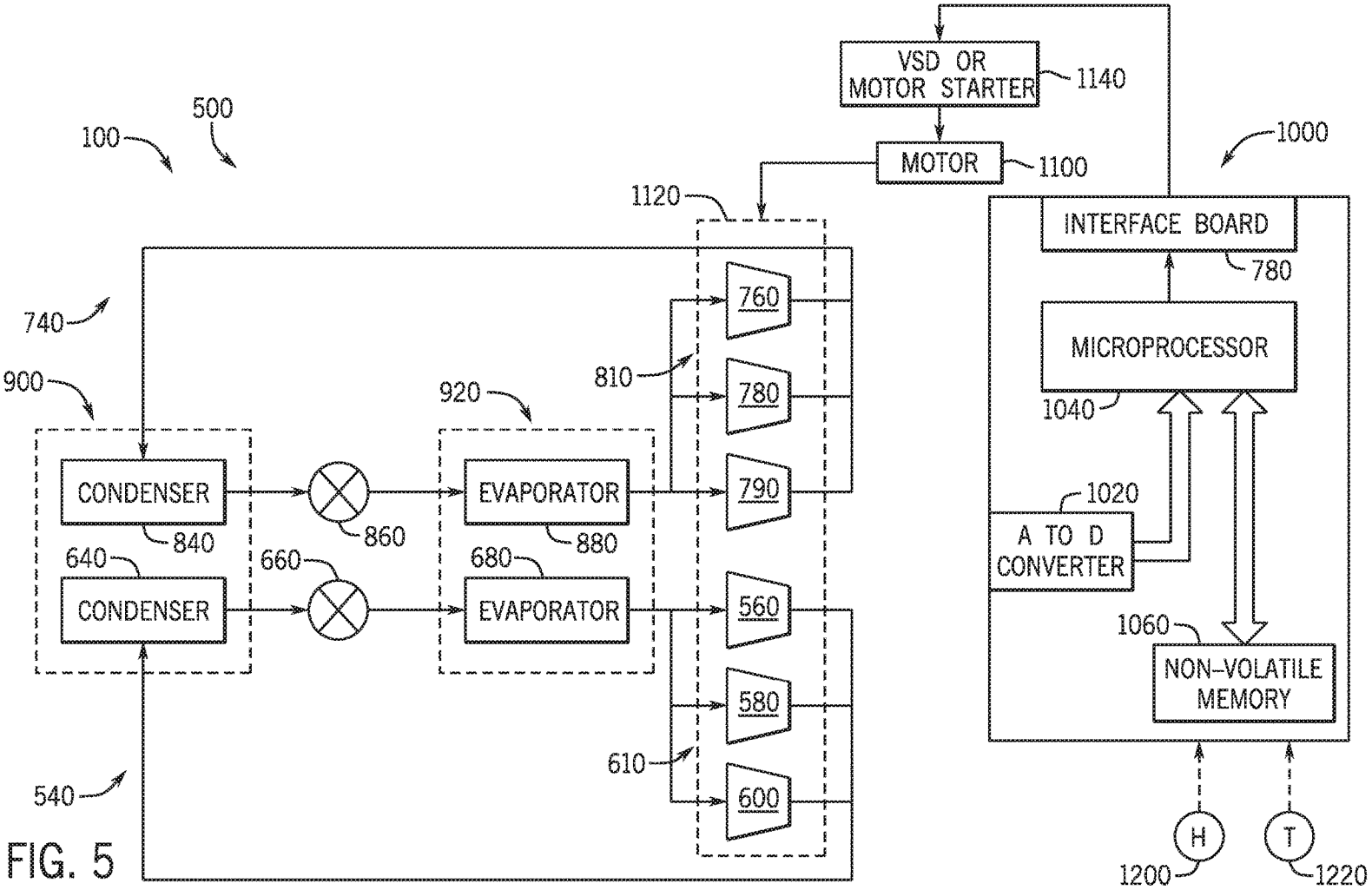
FIG. 5 is a schematic diagram of an embodiment of the HVAC system shown in FIG. 1 having two refrigeration circuits, in accordance with the present techniques.

FIG. 5 is a schematic of an embodiment of a multi-circuit refrigeration system 500 that may be used in any of the systems described above. For example, all or a portion of the components of the multi-circuit refrigeration system 500 may be included in an HVAC system 100 that may be included in the HVAC unit 12 of FIG. 1. As shown, the multi-circuit refrigeration system 500 includes two refrigeration circuits each having three compressors. The multi-circuit refrigeration system 500 can circulate a first refrigerant through a first refrigeration circuit 540 starting with a first compressor 560, a second compressor 580, and a third compressor 600. As shown, the compressors 560, 580, 600 (e.g., first plurality of compressors 610) are arranged in parallel. Further, the first refrigeration circuit 540 includes a first condenser 640, first expansion valve(s) or device(s) 660, and a first evaporator 680.

The compressors 560, 580, 600 compress a first refrigerant vapor and deliver the first refrigerant vapor to the first condenser 640 through a first discharge passage. In the parallel arrangement shown, the compressors 560, 580, 600 may each receive a respective portion of the first refrigerant vapor and compress the respective portion, which then rejoins the other respective portions downstream to form a first compressed refrigerant vapor. The compressors 560, 580, 600 can be screw compressors in some embodiments. However, the compressors 560, 580, 600 can be any suitable type of compressor, such as positive displacement compressors or centrifugal compressors. The first refrigerant vapor delivered by the compressors 560, 580, 600 to the first condenser 640 transfers heat to a fluid, such as water or air. The first refrigerant vapor condenses to a first refrigerant liquid in the first condenser 640 as a result of the heat transfer with the fluid. The first liquid refrigerant from the first condenser 640 flows through the first expansion device 660 to the first evaporator 680.

The first liquid refrigerant delivered to the first evaporator 680 absorbs heat from another fluid, which may or may not be the same type of fluid used for the first condenser 640, and undergoes a phase change to the first refrigerant vapor. In some embodiments, the first evaporator 680 includes a tube bundle having a supply line and a return line connected to a cooling load. The cooling load may be delivered to supply air that is provided from the HVAC system 100 to a space that is to be conditioned. A process fluid, for example, water, ethylene glycol, calcium chloride brine, sodium chloride brine, or any other suitable liquid, enters the first evaporator 680 via the return line and exits the first evaporator 680 via the supply line. The first evaporator 680 lowers the temperature of the process fluid in the tubes. The tube bundle in the evaporator 680 can include a plurality of tubes and a plurality of tube bundles. The first vapor refrigerant exits the first evaporator 680 and returns to the first plurality of compressors 610 by a suction line to complete the cycle of the first refrigeration circuit 540.

Further, the multi-circuit refrigeration system 500 can circulate a second refrigerant through a second refrigeration circuit 740 starting with a fourth compressor 760, a fifth compressor 780, and a sixth compressor 800. As shown, the compressors 760, 780, 800 (e.g., second plurality of compressors 810) are also arranged in parallel. Further, the second refrigeration circuit 740 includes a second condenser 840, second expansion valve(s) or device(s) 860, and a second evaporator 880. The components of the second refrigeration circuit 740 operate in a manner similar to the components of the first refrigeration circuit 540. However, the second refrigeration circuit 740 includes a second refrigerant separate from the first refrigerant. For example, the second plurality of compressors 810 compresses the second refrigerant, and the second condenser 840 condenses the second refrigerant vapor to provide a cooling capacity to the conditioned air. The second refrigerant is then recycled through the second expansion device 860 and the second evaporator 880 before the cycle of the second refrigeration circuit 740 begins again. Some examples of fluids that may be used as refrigerants (e.g., the first refrigerant or the second refrigerant) in the multi-circuit refrigeration system 500 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor, or any other suitable type of refrigerant.

Further, it is to be noted that the first refrigeration circuit 540 and the second refrigeration circuit 740 discussed herein are independent of one another. That is, the first refrigerant from the first refrigeration circuit 540 does not intermingle or mix with the second refrigeration circuit 740, and the second refrigerant from the second refrigeration circuit 740 does not intermingle or mix with the first refrigeration circuit 540. In some embodiments, the independence of the multiple refrigeration circuits is embodied by a lack of a shared interlaced coil to transfer refrigerant between the multiple refrigeration circuits. Accordingly, the refrigeration circuits may be independently operated and the efficiency of the entire HVAC system 100 may be increased. Additionally, while three compressors arranged in parallel are shown in each refrigeration circuit of two refrigeration circuits, it is to be understood that in other embodiments, more refrigeration circuits, more or less compressors, or any combination thereof may be used with the sequencing methods disclosed herein.

As shown, certain components of the first refrigeration circuit 540 and the second refrigeration circuit 740 may be disposed within a shared housing. For example, the first condenser 640 and the second condenser 840 may be disposed within a condenser housing 900. Similarly, the first evaporator 680 and the second evaporator 880 may be disposed within an evaporator housing 920. By disposing similar components within shared housings, the multi-circuit refrigeration system 500 may be more easily manufactured, transported, and installed. However, it is to be noted that the first refrigerant and the second refrigerant may not be transferred between the first refrigeration circuit 540 and the second refrigeration circuit 740 via the shared housings.

The multi-circuit refrigeration system 500 may include one or multiple control devices for sequencing the compressors. For example, similar to the control panel 82 shown in FIG. 4, the multi-circuit refrigeration system 500 can also include a control panel 1000 (e.g., a controller) that can include an analog to digital (A/D) converter 1020, a microprocessor 1040, a non-volatile memory 1060 (e.g., non-transitory code or instructions stored in a machine-readable medium), and an interface board 1080. For example, instructions for some or all of the control panel 1000 functionality described herein may be stored on the memory 1060.

As shown, a motor 1100 may be used to control the rotation of all of the compressors, as indicated by control area 1120. Alternatively, one motor 1100 may be provided to each compressor or provided to each plurality of compressors 610, 810. The motor 1100 may be powered by a variable speed drive (VSD) 1140. In some embodiments, the motor 1100 may be powered by another type of motor starter, such as a fixed speed starter. The VSD 1140 receives AC power having a particular fixed line voltage and fixed line frequency from an AC power source and provides power having a variable voltage and frequency to the motor 1100. The motor 1100 can include any type of electric motor that can be powered by the VSD 1140. The motor 1100 can be any suitable motor type, for example, a switched reluctance motor, an induction motor, or an electronically commutated permanent magnet motor.

The control panel 1000 can receive requests from a humidity sensor or humidistat 1200 and also receive requests from a temperature sensor or thermostat 1220. The requests may be signals transmitted from the humidity sensor or humidistat 1200 and the temperature sensor or thermostat 122 to indicate a request for cooling and/or a request for dehumidification with cooling. Further discussion of multi-circuit refrigeration systems 500 having hot gas reheat (HGRH) functionality that are able to provide dehumidification without cooling are discussed below with reference to FIGS. 6 and 7. The requests may be transmitted when a user interacts with the humidity sensor or humidistat 1200 and/or the temperature sensor or thermostat 1220. Additionally or alternatively, the requests may be transmitted to the control panel 1000 automatically by the humidity sensor or humidistat 1200 and/or the temperature sensor or thermostat 1220. Further, the requests may be automatically transmitted at preset intervals.

For example, if a temperature sensor transmits signals indicating that a temperature of the space to be conditioned is greater than a temperature threshold, the temperature sensor or thermostat 1220 may transmit a request to the control panel 1000 for cooling to be initiated or increased. Additionally, if a humidity sensor transmits signals indicating that a humidity of the space to be conditioned is greater than a humidity threshold, the humidity sensor or humidistat 1200 may transmit a request to the control panel 1000 for dehumidification to be initiated or increased. Accordingly, the multi-circuit refrigeration system 500 may receive the request and control operation of the multi-circuit refrigeration system 500 to achieve cooling or dehumidification with cooling.

As discussed above, operation of the compressors may be sequenced based on the requests received by the control panel 1000 for conditioned air to be cooled or dehumidified and cooled. As adjustment to a respective cooling load or a respective dehumidification load is requested, the control panel 1000 may energize a compressor that is sequenced to be energized within the selected compressor mode. That is, a sequence of compressors may be generated or selected, and when an adjustment to the cooling load or the dehumidification load is requested, the control panel 1000 may energize the compressor that is next in the sequence. The HVAC system 100 may sequence compressor operation via two operating modes: a balanced compressor mode or a clustered compressor mode. If only cooling is requested, the HVAC system 100 may sequence the compressors in the balanced compressor mode to increase the cooling capacity of the multi-circuit refrigeration system 500. If cooling and dehumidification are requested, the HVAC system 100 may sequence the compressors in the clustered compressor mode to increase the cooling capacity and the dehumidification capacity of the multi-circuit refrigeration system 500.

In the balanced compressor mode, the control panel 1000 sequences and may energize a generally equal number of compressors from both the first refrigeration circuit 540 and the second refrigeration circuit 740. That is, if the first compressor 560 is activated and the control panel 1000 receives a request for an increased cooling load, the control panel 1000 may energize the fourth compressor 760 of the second refrigeration circuit 740 to meet the increased demand for cooling. If the demand for cooling further increases, with an equal number of compressors energized in the first refrigeration circuit 540 and the second refrigeration circuit 740, the control panel 1000 may sequence any compressor on either circuit for energization. In some embodiments, all compressors of all refrigeration circuits may be sequenced before any requests indicative of an increase in cooling are received by the control panel 1000. The sequence may be a comprehensive sequence ordering the energization of most or all of the compressors of the first refrigeration circuit and the second refrigeration circuit 740. In these embodiments, selective energization of the sequenced compressors may be undertaken rapidly from the previously generated sequence (e.g., comprehensive sequence) without the need for further processing steps.

In some embodiments of the balanced compressor mode, the control panel 1000 may sequence compressors on strictly alternating refrigeration circuits. For example, the control panel may sequence the first compressor 560, then the fourth compressor 560, then the second compressor 580, then the fifth compressor 780, then the third compressor 600, then the sixth compressor 800. As such, there may be, at most, one more compressor sequenced in a refrigeration circuit than in any other refrigeration circuit. The sequencing methods disclosed herein may also be applied to multi-circuit refrigeration systems having a different number of refrigeration circuits or compressors in each refrigeration circuit.

In the clustered compressor mode, each compressor of a refrigeration circuit may be energized before any compressors of another refrigeration circuit. That is, if the first compressor 560 is energized, and the control panel 1000 receives a request for increased dehumidification, the control panel 1000 may next energize the second compressor 580 to meet the increased demand for dehumidification. If the demand for dehumidification further increases, the control panel 1000 may further energize the third compressor 600. However, in some embodiments, the control panel 1000 may energize the third compressor 600 before the second compressor 580 based on compressor operation parameters discussed below. In some embodiments, all compressors of all refrigeration circuits may be sequenced before any requests indicative of an increase in or and dehumidification are received by the control panel 1000. In these embodiments, selective energization of the sequenced compressors may be undertaken rapidly from the previously generated sequence without the need for further processing steps.

Indeed, the control panel 1000 may determine the order of compressor sequencing based on compressor operation parameters including an operational run time of each compressor, a start count of each compressor, a capacity of each compressor, a status of each compressor, or any combination thereof. The compressor operation parameters of each compressor may be monitored and updated throughout the lifetime of the HVAC system 100. For example, the control panel 1000 may keep a count of each time each compressor is energized. Such data may be stored in the non-volatile memory 1060. Each energization of the compressor may result in a small amount of wear associated with the refrigerant initially flowing through the compressor. Accordingly, each energization may be recorded by the control panel 1000, which increases the start count of the compressor. In determining which compressor to next sequence in a respective refrigeration circuit, the control panel 1000 may select the compressor with the lowest start count to equally distribute natural wear among all compressors. If one or more compressors have the same start count, the control panel 1000 may also consider other compressor operation parameters, such as the operational run time of each compressor.

For example, the compressor may determine which compressor to next sequence based on the operational run time of each compressor. The control panel 1000 may keep a log of how many minutes, hours, days, and/or years each compressor has been operating, and such data may be stored in the non-volatile memory 1060. Accordingly, the control panel 1000 may decide to next sequence the compressor with the lowest operational run time, thus equally distributing normal wear among the compressors. If one or more compressors have the same operating time, the control panel 1000 may also consider other compressor operation parameters, such as the start count of each compressor. Additionally, the control panel 1000 may consider more than one compressor operation parameters generally (e.g., each time the HVAC system 100 is operating). In some embodiments, calculations for determining which compressor to sequence next may accordingly weigh one or more compressor operation parameters equally, or the calculations may weigh one or more compressor operation parameter differently from other compressor operation parameters.

Additionally, the control panel 1000 may consider the capacity (e.g., cooling capacity, dehumidification capacity) of each compressor when selecting which compressor to next sequence. The considerations of capacity may update the sequencing of the compressors as new requests are received. For example, if the control panel 1000 determines that 30 MW of cooling is needed, and the remaining compressors available in the operation mode are 20 MW and 40 MW, the control panel 1000 may activate the 40 MW compressor first. Even if the 20 MW compressor has a lower start count and/or a lower operational run time, the control panel 1000 may sequence then energize the 40 MW compressor. To simplify discussion, the compressors will be referred to as having the same capacity. However, it is to be understood that compressors with various capacity may also be activated generally based on the operation modes discussed herein.

The control panel 1000 may additionally consider the status of compressors in determining the compressor sequencing. For example, the control panel 1000 may store a compressor operation parameter for each compressor indicative of whether each compressor is online (e.g., healthy, operational). The control panel 1000 may therefore remove compressors that are not online from the compressor sequencing. For example, if the third compressor 560 is not online, but the control panel 1000 is operating in the clustered mode, the control panel 1000 may sequence the first compressor 600, then the second compressor 580, then the fourth compressor 760, then the fifth compressor 780, then the sixth compressor 800. In this manner, each offline compressor is excluded from the sequencing methods. The compressor may periodically update statuses for each compressor, receive input from an operator when a compressor is taken offline, or a combination thereof.

Additionally, the techniques disclosed herein may be utilized to switch between a cooling mode or a dehumidification and cooling mode during operation of the HVAC system 100. For example, based on requests received from the humidity sensor or humidistat 1200 and the temperature sensor or thermostat 1220, the control panel 1000 may switch from the cooling mode to the dehumidification and cooling mode while generating conditioned air. The control panel 1000 then changes the HVAC system 100 operation mode from the balanced compressor mode to the clustered compressor mode. Each compressor of the multi-refrigeration circuit 500 may then be sequenced again. To achieve the transition in compressor mode, the control panel 1000 may store a transition parameter indicative of whether a smooth transition mode or a rapid transition mode is desired. Additionally, while only two transition modes are discussed herein, it is to be understood that other transition modes, such as a moderate transition mode, may also be employed by the techniques discussed herein.

To achieve the transition in compressor mode, the control panel 1000 may be operated in the smooth transition mode or the rapid transition mode. In the smooth transition mode, the control panel 1000 may adapt the future energization of compressors in line with the newly generated or selected sequence of compressors. That is, in the smooth transition mode, the control panel 1000 may sequence activation of compressors to achieve a gradual shift to the desired compressor mode, without forcibly deactivating or activating compressors. The smooth transition mode may therefore keep a start count of each compressor at a minimum. However, the transition between operation modes may take some time to complete. Indeed, compressors not in alignment with the desired operating mode may be deactivated only when a load of the HVAC system is decreased, and compressors aligned with the desired operating mode may be activated only when the load of the system is increased. The tradeoff between speed of transition and wear on compressors is a design choice adaptive to each individual HVAC system 100.

In the rapid transition mode, the control panel 1000 may sequence compressors in line with the new operating mode, and then shut down compressors that are not in line with the new sequence before or after energizing compressors that are in line with the new sequence. That is, in the rapid transition mode, the control panel 1000 may sequence the compressors in line with the new operating mode, then energize or shut down the necessary compressors to achieve the new operating mode. The rapid transition mode may therefore increase a start count of certain compressors. In some embodiments, the control panel 1000 may energize and shut down the compressors that are not in line with the new sequence within a time threshold, such as 10 minutes, 60 minutes, 120 minutes, or the like. However, the control panel 1000 may not shut down any compressors that have not been operating for a minimum operational run time. By only shutting down compressors after the minimum operational run time has passed, the control panel 1000 ensures the refrigerant of each refrigeration cycle has reached a well-mixed state. The tradeoff between speed of transition and wear on compressors is a design choice adaptive to each individual HVAC system 100.

As an example of a transition between operating modes, consider the multi-circuit refrigeration system 500 in which dehumidification and cooling are requested, so the control panel 1000 is operating the clustered compressor mode. Accordingly, the first compressor 560, the second compressor 580, and the third compressor 600 may be energized. If a new request from the humidity sensor or humidistat 1200 indicates dehumidification is no longer desired, the control panel 1000 may transition to the balanced compressor mode. First, the control panel 1000 sequences the compressors in accordance with the balanced compressor mode and the compressor operation parameters (e.g., offline compressors, operational run times, and start counts). Assuming the compressor operation parameters for each compressor are equal, the new sequence of operation includes the first compressor 560, then the fourth compressor 760, then the second compressor 580, then the fifth compressor 780, then the third compressor 600, the then sixth compressor 800. Assuming a magnitude of the desired cooling load requires only two compressors to be energized, the control panel may therefore shutdown the second compressor 580 and the third compressor 600 and energize the fourth compressor 760, in accordance with the balanced operating mode requiring two compressors.

If the example of the transition were performed in the smooth transition mode, the shutdown of the third compressor 600 may occur immediately, as the requested cooling load requires only two energized compressors. As a result, only the first compressor 560 and the second compressor 580 are energized. However, according to the new compressor sequence in the balanced compressor mode, the second compressor 580 should be shut down and the fourth compressor 760 should be energized. Because the control panel 1000 is operating in the smooth transition mode, the transition may only be made once the required cooling load of the system has decreased and the second compressor 580 may be naturally shut down. Then, when the desired cooling load increases, the control panel 1000 may energize the fourth compressor 760, in line with the balanced compressor mode.

Alternatively, if the example of the transition was performed in the rapid transition mode, the shutdown of the third compressor 600 may still occur immediately, as the requested cooling load requires only two energized compressors. Further, assuming the minimum operational run time has passed, the control panel 1000 would also shut down the second compressor 580, and then energize the fourth compressor 760. As a result, the first compressor 560 and the fourth compressor 760 are energized. Accordingly, the energized compressors are in line with to the new compressor sequence in the balanced compressor mode.

Figure 6:
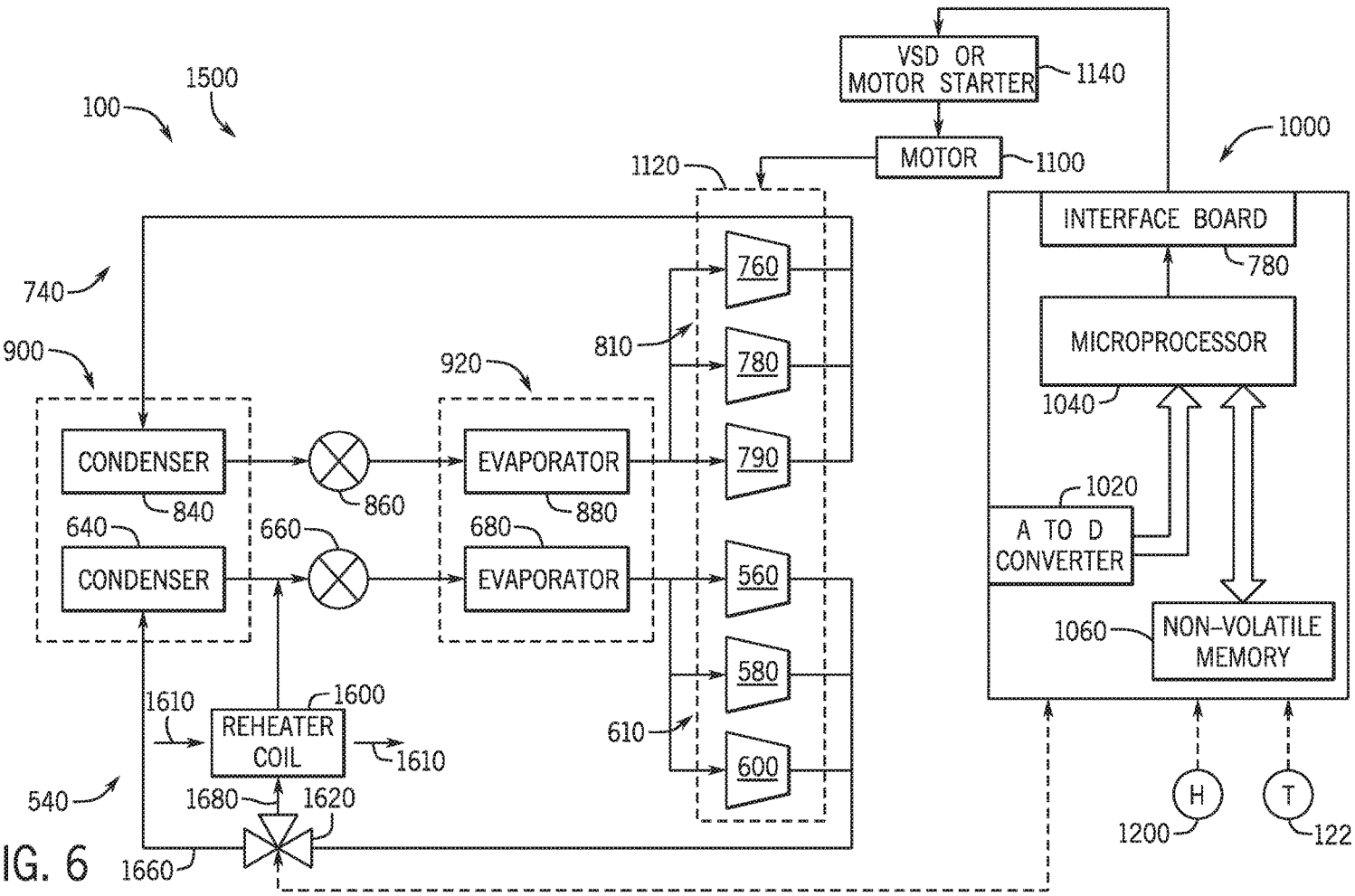
FIG. 6 is a schematic diagram of an embodiment of the HVAC system shown in FIG. 1 having two refrigeration circuits and a reheater coil, in accordance with the present techniques.

FIG. 6 is a schematic of an embodiment of a multi-circuit refrigeration system 1500 having HGRH functionality that may be used in the HVAC system 100. All or a portion of the components of the multi-circuit refrigeration system 1500 may be included in the HVAC unit 12 of FIG. 1. As shown, the multi-circuit refrigeration system 1500 includes many similar elements as FIG. 5, including two refrigeration circuits each having three compressors. For simplification of the present discussion, it is noted that components having the same element numbers in FIG. 5 and FIG. 6 are approximately equivalent. However, it is to be understood that the techniques described herein may also apply to systems in which the multi-circuit refrigeration system 1500 does not generally approximate the multi-circuit refrigeration circuit 500 of FIG. 5.

As shown, the multi-circuit refrigeration system 1500 has a reheater coil 1600 (e.g., reheat heat exchanger) that permits conditioned air to be dehumidified without cooling. The multi-circuit refrigeration system 1500 also includes the first refrigeration circuit 540 and the second refrigeration circuit 740. However, the first refrigeration circuit 540 further includes the reheater coil 1600. The reheater coil 1600 is in fluid communication with to a three-way valve 1620 that is controlled by the control panel 1000. The three-way valve 1620 receives all first compressed refrigerant from the first plurality of compressors 610. The three-way valve 1620 may provide all of the first compressed refrigerant to the first condenser 640 along a first flow path 1660, all of the first compressed refrigerant to an outlet of the first condenser 640 along a second flow path 1680, or part of the first compressed refrigerant along both the first and second flow paths 1660, 1680. The three-way valve 1620 may receive a signal from the control panel 1000 indicative of target flowrates along both the first and second flow paths 1660, 1680. Based on the signal, the three-way valve may control the flow of the first compressed refrigerant along the first and second flow paths 1660, 1680 to achieve the target flowrates.

If the three-way valve 1620 directs part or all of the first compressed refrigerant along the second flow path 1680, the first compressed refrigerant may be cooled by the reheater coil 1600. That is, the reheater coil 1600 may transfer heat to supply air 1610 provided to a space to be conditioned. By transferring heat from the reheater coil 1600 to the supply air 1610, the HVAC system 100 may provide conditioned air that has been dehumidified without being cooled. For example, return air and/or outside air inlet to the HVAC system 100 may be cooled such that moisture within the air is reduced or removed and supply air 1610 is generated. Then, if dehumidification without cooling is requested, the supply air 1610 may flow over the warm reheater coil 1600 to return the supply air 1610 to a desired, uncooled temperature. Accordingly, by energizing compressors on the first refrigeration circuit 540 comprising the reheater coil 1600, the HVAC system 100 may increase a dehumidification load and decrease a cooling load. In this manner, the HVAC system 100 may be operated in an operating mode that provides dehumidification without cooling.

To provide dehumidification without cooling, the control panel 1000 may sequence compressors in the clustered compressor mode, such that the first refrigerant may remove humidity from the return air without lowering its temperature. As such, if requests from the humidity sensor or humidistat 1200 and the temperature sensor or thermostat 1220 indicate that dehumidification without cooling is requested, the control panel 1000 may operate in the clustered compressor mode, while favoring the first refrigeration circuit 540 including the reheater coil 1600. As such, the first compressor 560 may be sequenced, and then the second compressor 580, and then the third compressor 600, before any compressors of other refrigeration circuits are sequenced. In addition, the control panel 1000 may sequence the compressors each time the operating mode changes. Once sequenced, the compressors may be energized to provide the desired dehumidification capacity.

As similarly discussed above with reference to FIG. 5, the multi-circuit refrigeration system 1500 may also operate in the balanced mode to maintain a generally equal number of compressors sequenced and energized on each refrigeration circuit. Further, the multi-circuit refrigeration system 1500 may additionally make transitions between compressor modes via the smooth transition more or the rapid transition mode. In deciding which compressor to next sequence, the control panel 1000 may additionally consider the compressor operation parameters previously discussed, including, but not limited to start count, operational time, capacity, and status.

Figure 7:
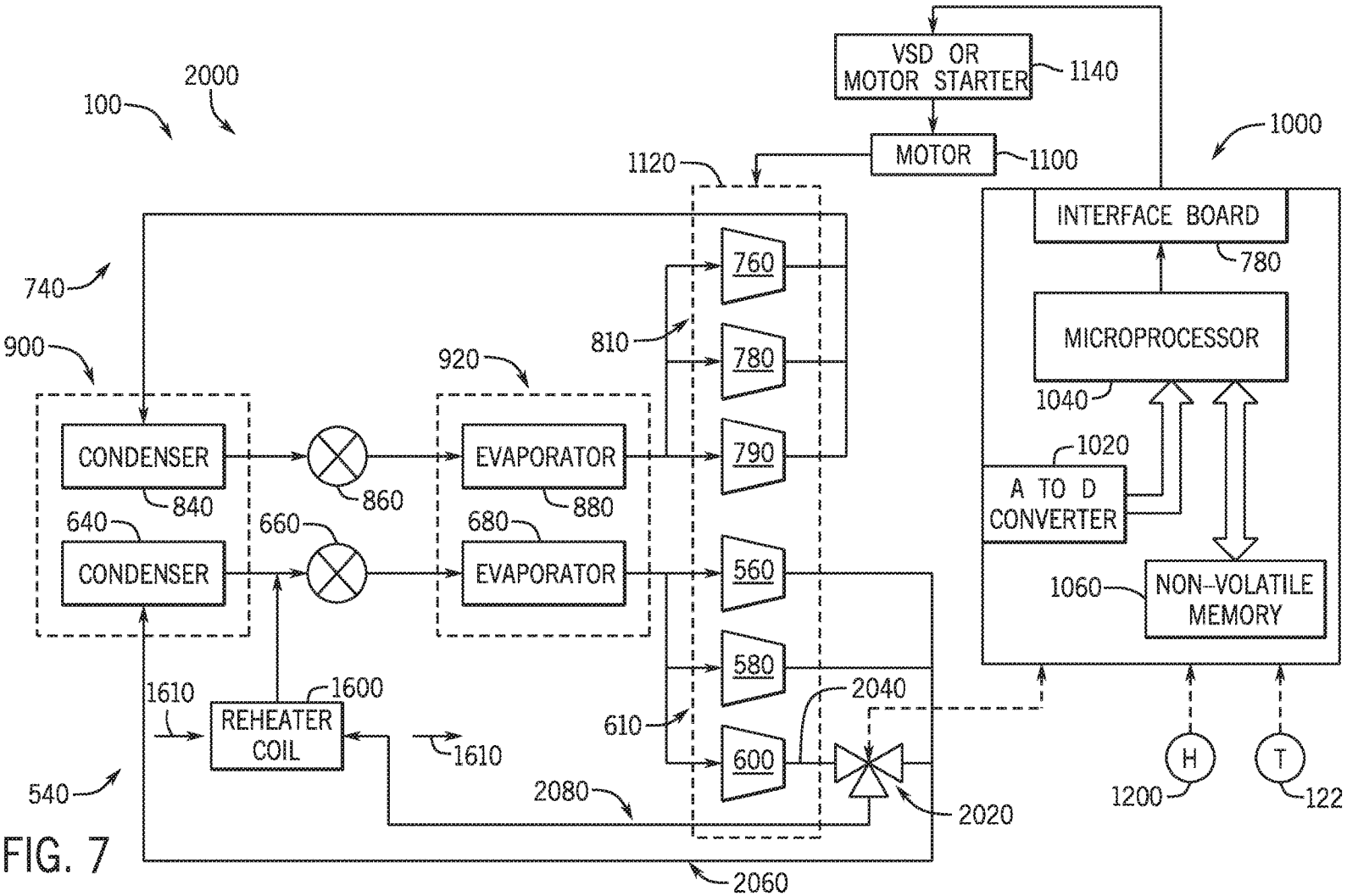
FIG. 7 is a schematic diagram of an embodiment of the HVAC system shown in FIG. 1 having two refrigeration circuits and a reheater coil, in accordance with the present techniques.

FIG. 7 is a schematic of an embodiment of a multi-circuit refrigeration system 2000 having HGRH functionality that may be used in the HVAC system 100. All or a portion of the components of the multi-circuit refrigeration system 2000 may be included in the HVAC unit 12 of FIG. 1. As shown, the multi-circuit refrigeration system 2000 includes similar elements as FIGS. 5 and 6, including two refrigeration circuits, each having three compressors. For simplification of the present discussion, it is noted that components having the same element numbers in FIGS. 5-7 are approximately equivalent. However, it is to be understood that the techniques described herein may also apply to systems in which the multi-circuit refrigeration system 2000 does not generally approximate the multi-circuit refrigeration circuit 500 of FIG. 5 or the multi-circuit refrigeration circuit 1500 of FIG. 6.

The multi-circuit refrigeration system 2000 also includes the reheater coil 1600 to enable dehumidification of conditioned air without cooling. The multi-circuit refrigeration system 2000 further includes a three-way valve 2020 disposed along the first refrigeration circuit 540. In contrast to the three-way valve 1620 of FIG. 6, the three-way valve 2020 is disposed along an outlet 2040 of the third compressor 600. Accordingly, the three-way valve 2020 receives only the first compressed refrigerant that flows through the third compressor 600. The three-way valve 2020 may receive signals from the control panel 1000 to determine what quantities of the compressed refrigerant to direct along a first flow path 2060 to the first condenser 640 and a second flow path 2080 to the reheater coil 1600.

As discussed above with reference to FIG. 6, the reheater coil 1600 enables the HVAC system 100 to provide dehumidification without cooling to the supply air 1610. In this manner, the multi-circuit refrigeration circuit 2000 is another example of how HGRH functionality may be included in the HVAC system 100 to provide dehumidification without cooling. Indeed, it is to be understood that many reheater coils 1600 and three-way valves 2020, or other equivalent components may be utilized in the HVAC system 100 to provide desired dehumidification loads and/or cooling loads. Additionally, if dehumidification is requested, the control panel 1000 will operate in the clustered compressor mode via the refrigeration circuit having the HGRH functionality (e.g., the reheater coil 1600).

Figure 8:
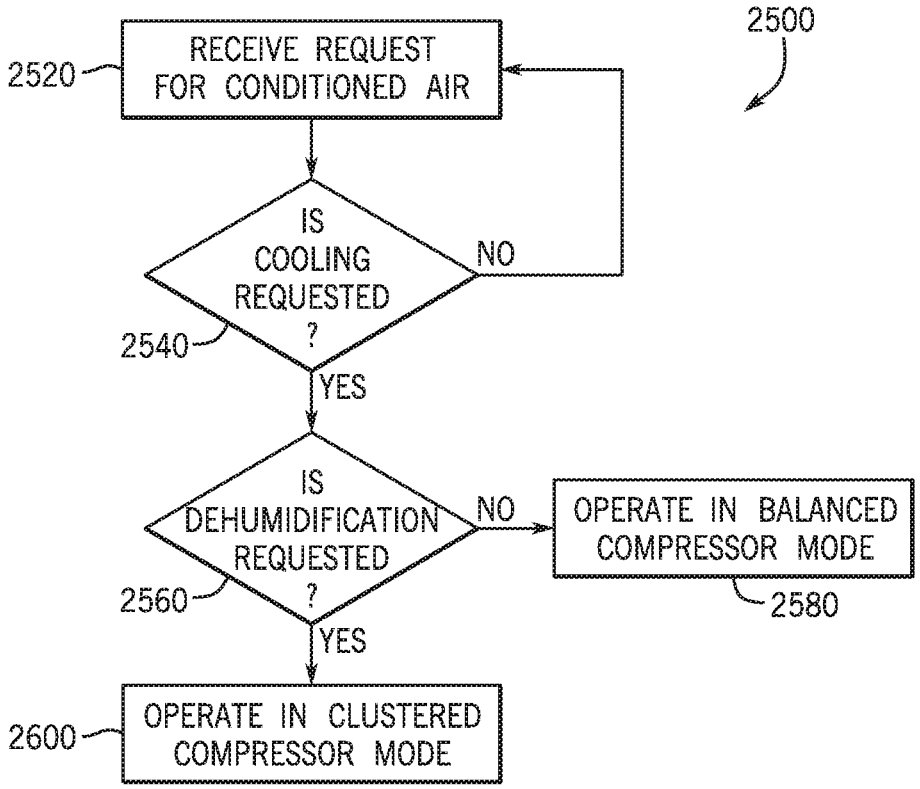
FIG. 8 is a flowchart of a method for determining the compressor mode of the HVAC system shown in FIG. 5 without a reheater coil, in accordance with the present techniques.

FIG. 8 illustrates a flowchart of a method 2500 that may be employed to determine the compressor mode of the HVAC system 100 without a reheater coil, such as the multi-circuit refrigeration system 500 of FIG. 5. In these embodiments, the HVAC system 100 may operate to provide conditioned air that has been cooled or dehumidified and cooled. It is to be understood that the steps discussed herein are merely exemplary, and certain steps may be omitted or performed in a different order that the order discussed herein. First, the method 2500 may include receiving a request for conditioned air (block 2520). For example, the control panel 1000 may receive the request for cooling from the temperature sensor or thermostat 1220 or a request for cooling and dehumidification from the humidity sensor or humidistat 1200 and the temperature sensor or thermostat 1220. The control panel 1000 may receive the requests and use the method 2500 to determine the operating mode by which to sequence the compressors of the multi-circuit refrigeration system 500.

The method 2500 may next include determining (node 2540) if cooling is requested. If cooling is not requested, the control panel 1000 may then continue to receive requests from the temperature sensor or thermostat 1220 and the humidity sensor or humidistat 1200 until cooling is requested. If the control panel 1000 determines (node 2540) that cooling is requested, the method 2500 may further include determining (node 2560) if dehumidification is requested. For example, if the request from the humidity sensor or humidistat 1200 indicates that dehumidification of the conditioned air is not requested, the control panel 1000 determines that the compressors will be sequenced in the balanced compressor mode (block 2580). If the request indicates that dehumidification of the conditioned air is requested, then the control panel 1000 will determine that the compressors will be sequenced in the clustered compressor mode (block 2600). As discussed above, the balanced compressor mode may provide a more energy efficient form of cooling, while the clustered mode may provide a more energy efficient form of cooling and dehumidification.

Figure 9:
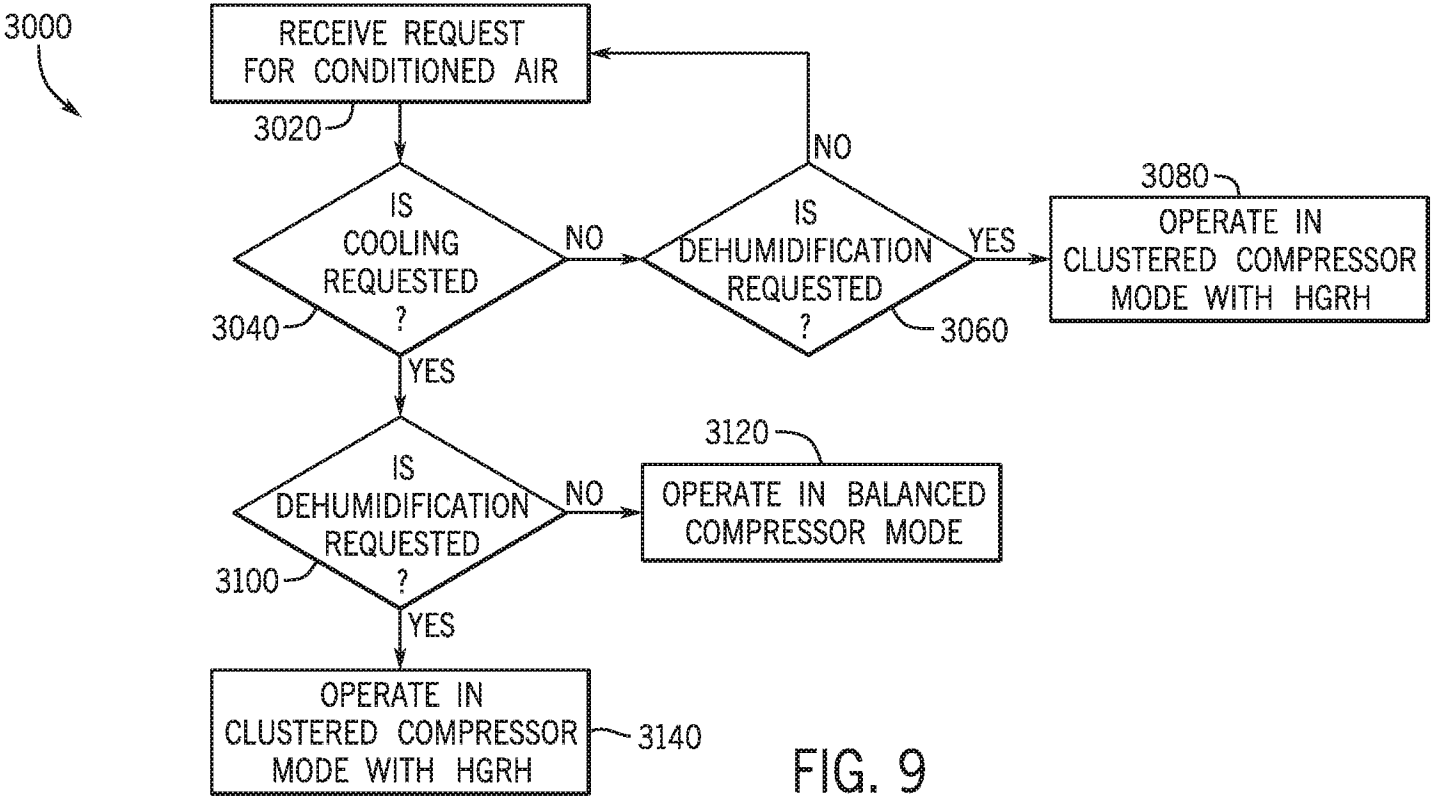
FIG. 9 is a flowchart of a method for determining the compressor mode of the HVAC system shown in FIG. 6 or 7 having a reheater coil, in accordance with the present techniques.

FIG. 9 illustrates a method 3000 that may be employed to determine the compressor mode of the HVAC system 100 having the reheater coil 1600. The HVAC system 100 includes a multi-circuit refrigeration system, such as one of the multi-circuit refrigeration systems 1500 and 2000 of FIGS. 6 and 7. In these embodiments, the HVAC system 100 may operate to provide conditioned air that has been cooled, dehumidified, or dehumidified and cooled. It is to be understood that the steps discussed herein are merely exemplary, and certain steps may be omitted or performed in a different order than the order discussed herein. First, the method 3000 may include receiving a request for conditioned air (block 3020). For example, the control panel 1000 may receive the request for cooling from the temperature sensor or thermostat 1220, a request for dehumidification from the humidity sensor or humidistat 120, or a request for cooling and dehumidification from the humidity sensor or humidistat 1200 and the temperature sensor or thermostat 1220. The control panel 1000 may receive the requests and use the method 3000 to determine the operating mode by which to best sequence the compressors of the multi-circuit refrigeration systems 1500, 2000.

The method 2500 may next include determining (node 3040) if cooling is requested. For example, the control panel 1000 may receive the requests from the humidity sensor or humidistat 1200 and the temperature sensor or thermostat 1220. Further, the control panel 1000 analyzes the requests to determine what type of conditioning, if any, is requested. If cooling is not requested, the method 3000 may include determining (node 3060) if dehumidification is requested. If the control panel determines that dehumidification without cooling is requested, the control panel 1000 then operates in the clustered compressor mode via the refrigeration circuit having the reheater coil 1600 (block 3080).

Returning to node 3040, if the method 3000 determines that cooling is requested, the method 3000 further determines (node 3100) if dehumidification is requested. If cooling without dehumidification is requested, the control panel 1000 operates in the balanced compressor mode (block 3120). In the balanced compressor mode, generally equal quantities of compressors are sequenced on each refrigeration circuit. Returning to node 3100, if cooling and dehumidification and cooling are requested, the control panel 1000 sequences compressors in the clustered compressor mode via the refrigeration circuit having the reheater coil 1600 (block 3140). As discussed above, the balanced compressor mode may provide a more energy efficient form of cooling without dehumidification, while the clustered mode may provide a more energy efficient form of dehumidification, or cooling and dehumidification.

Figure 10:
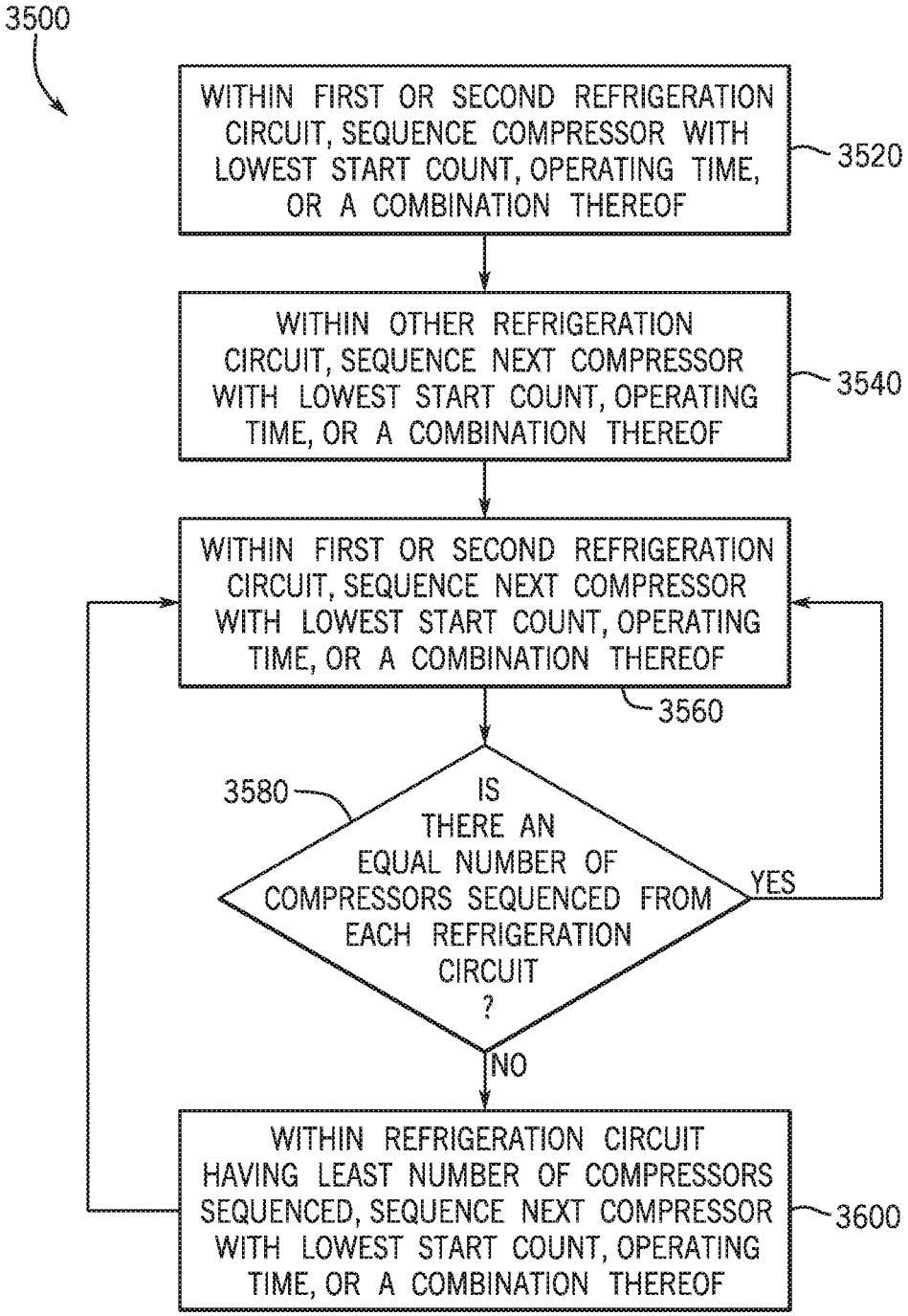
FIG. 10 is a flowchart of a method for sequencing operation of compressors in a balanced compressor mode, in accordance with the present techniques.

FIG. 10 illustrates a method 3500 that may be employed to sequence operation of compressors in a balanced compressor mode. Because operation in the balanced compressor mode is performed when HGRH functionality is not utilized, the method 3500 may be used in the HVAC system 100 with or without HGRH functionality. The balanced compressor mode is generally selected for sequencing of compressors when more energy efficient cooling without dehumidification is requested. It is to be understood that the steps discussed herein are merely exemplary, and certain steps may be omitted or performed in a different order that the order discussed herein. Additionally, while only two refrigeration circuits are referred to herein, it is to be understood that the method 3500 may be applied to sequence compressors of more than two refrigeration circuits in the balanced compressor mode. The method 3500 may be performed by the control panel 1000 discussed above.

First, the method 3500 may include, within the first or second refrigeration circuit, sequencing the compressor with the lowest start count, operating time, or a combination thereof (block 3520). That is, based on the compressor operation parameters and across both refrigeration circuits, the method 3500 may select the compressor with the least amount of physical wear to sequence first. Additionally, the method 3500 may next include, within the other refrigeration circuit, sequencing the next compressor with the lowest start count, operating time or a combination thereof (block 3540). Accordingly, one compressor from each refrigeration circuit is sequenced. Next, within either the first or the second refrigeration circuit, the method 3500 includes sequencing the next compressor with the lowest start count, operating time, or a combination thereof (block 3560). Accordingly, one more compressor is sequenced on one refrigeration circuit than the other.

Further, the method 3500 includes determining (node 3580) if there is an equal number of compressors sequenced from each refrigeration circuit. Because two compressors are sequenced on one refrigeration circuit and only one compressor is sequenced on the other refrigeration circuit, there are not an equal number of compressors sequenced from each refrigeration circuit. Accordingly, the method 3500 proceeds to, within the refrigeration circuit having the least number of compressors sequenced, sequence the next compressor having the lowest, start count, operating time, or a combination thereof (block 3600). At this instance, an equal number of compressors are sequenced on each refrigeration circuit. Then, so long as there are other online compressors to sequence, the method 3500 cycles back to, within the first or the second refrigeration circuit, sequence the next compressor with the lowest start count, operating time, or a combination thereof (block 3560). This time, the method 3500 determines (node 3580) that an equal number of compressors are sequenced from each refrigeration circuit. Accordingly, so long as there are other online compressors to sequence, the method 3500 sequences back to, within the first or the second refrigeration circuit, sequence the next compressor having the lowest start count, operating time, or a combination thereof (block 3560). The method 3500 will continue sequencing compressors, maintaining a generally equal of compressors sequenced on each refrigeration circuit until each compressor is sequenced.

Figure 11:
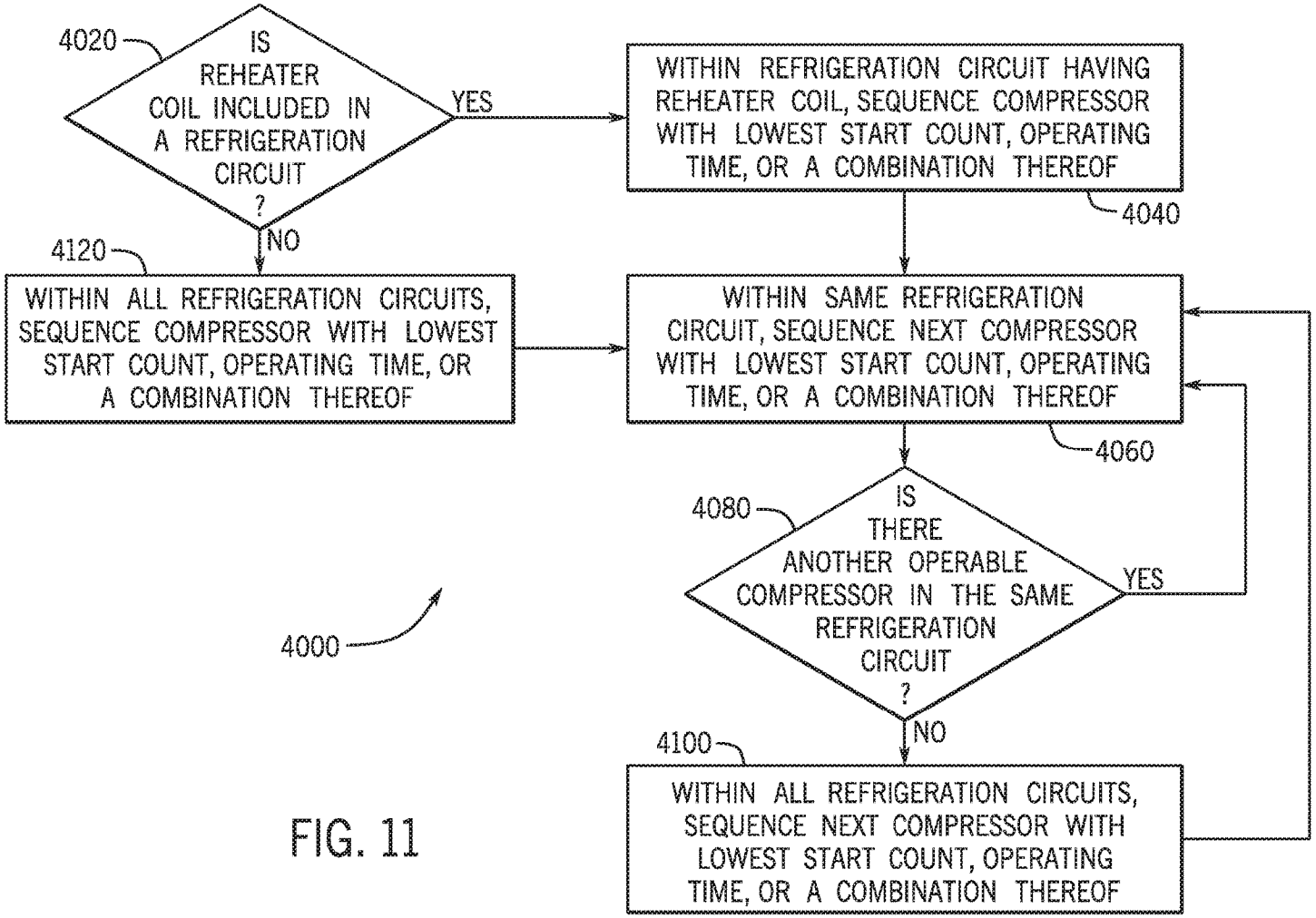
FIG. 11 is a flowchart of a method for sequencing operation of compressors in a clustered compressor mode, in accordance with the present techniques.

FIG. 11 depicts a method 4000 that may be employed to sequence operation of compressors in a clustered compressor mode. Because operation in the clustered compressor mode is performed when dehumidification is requested, the clustered compressor mode may be used when dehumidification or dehumidification and cooling are requested. Accordingly, the method 4000 may be used in the HVAC system 100 with or without HGRH functionality. It is to be understood that the steps discussed herein are merely exemplary, and certain steps may be omitted or performed in a different order that the order discussed herein. Additionally, while only two refrigeration circuits are referred to herein, it is to be understood that the method 4000 may be applied to sequence compressors of more than two refrigeration circuits in the clustered compressor mode. The method 4000 may be performed by the control panel 1000 discussed above.

First, the method 4000 may include determining (node 4020) if the reheater coil 1600 is included in a refrigeration circuit. In this manner, the method 4000 determines if one or more refrigeration circuits should be favored and sequenced first in the clustered compressor mode. If the reheater coil 1600 is included, the method 4000 includes, within the refrigeration circuit having the reheater coil 1600, sequencing the compressor with the lowest start count, operating time, or a combination thereof (block 4040). That is, based on the compressor operation parameters of the compressors within the refrigeration circuit having the reheater coil, the method 4000 may select the compressor with the least amount of physical wear to sequence first. If the reheater coil 1600 receives compressed refrigerant from only one compressor, the method 4000 may first sequence the one compressor, such as the first compressor 56 of FIG. 5. Additionally, the method 4000 may next include, within the same refrigeration circuit, sequencing the next compressor with the lowest start count, operating time or a combination thereof (block 4060). Accordingly, two compressors from the refrigeration circuit with the reheater coil 1600 are sequenced.

Next, the method 4000 may determine (node 4080) whether there is another operable compressor in the same refrigeration circuit. If there is another operable (e.g., existing and online) compressor within the same refrigeration circuit, the method 4000 may cycle back to continue sequencing each compressor of the same refrigeration circuit according to their compressor operating parameters. When all operable compressors are sequenced in the same refrigeration circuit, the method 4000 may include, within all remaining refrigeration circuits, sequencing the next compressor with the lowest start count, operating time, or a combination thereof (block 4100). Then, the method 4000 may cycle back to block 4060 to continue sequencing compressors of the next selected refrigeration circuit in the clustered compressor mode. Accordingly, all operable compressors of one refrigeration circuit are sequenced before all other compressors of other refrigeration circuits. The compressors of each refrigeration circuit may be sequenced based on the method 4000. The method 4000 will continue sequencing all compressors of each refrigeration circuit before sequencing all compressors of a next refrigeration circuit and so on until each compressor is sequenced.

Further, if the method 4000 determines (node 4020) that there is not a reheater coil 1600 included in the refrigeration circuit, block 4120 may be performed in place of the block 4040, such that within all refrigeration circuits, the method 4000 initially sequences the compressor with the lowest start count, operating time, or a combination thereof. Accordingly, the clustered compressor mode may be used for providing dehumidification with cooling to multi-circuit refrigeration systems without reheater coils, such as the multi-circuit refrigeration circuit 500 of FIG. 5.

Accordingly, the present disclosure is directed to a multi-circuit HVAC system that optimally sequences operation of compressors of the HVAC system between a balanced compressor mode and a clustered compressor mode based on space humidity. The balanced compressor mode may provide for efficient cooling capacity while the clustered compressor mode may provide for more efficient dehumidification capacity. The compressor sequencing may also account for a start count of each compressor, an operational run time of each compressor, a status of each compressor, and/or a capacity of each compressor, a transition mode of the controller among other compressor operation parameters. Accordingly, compressor sequencing, as described herein, may be optimized to increase efficiency and reduce costs of the HVAC system, while maintaining return air within desired temperature and humidity values.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the embodiments, all features of an actual implementation may not have been described (i.e., those unrelated to the presently contemplated best mode of carrying out the disclosure, or those unrelated to enabling the claimed features). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A multi-circuit refrigeration system, comprising:

a first refrigeration circuit, comprising:

a first plurality of compressors, wherein each compressor of the first plurality of compressors is configured to compress a first gaseous refrigerant into a first compressed refrigerant;

a second refrigeration circuit independent of the first refrigeration circuit, wherein the second refrigeration circuit comprises:

a second plurality of compressors, wherein each compressor of the second plurality of compressors is configured to compress a second gaseous refrigerant into a second compressed refrigerant; and a control panel configured to:

receive an input related to humidity from a humidity sensor or humidistat; and based on the input, sequence operation of the first plurality of compressors and the second plurality of compressors between a balanced mode and a clustered mode, wherein, in the balanced mode, a first compressor of the first plurality of compressors and a first compressor of the second plurality of compressors are energized before a second compressor of the first plurality of compressors or a second compressor of the second plurality of compressors is energized, and wherein, in the clustered mode, the first compressor and the second compressor of the first plurality of compressors are energized before the first compressor or the second compressor of the second plurality of compressors is energized.

2. The multi-circuit refrigeration system of claim 1, wherein the first refrigeration circuit comprises:

a reheat circuit configured to direct a portion of the first compressed refrigerant from at least one compressor of the first plurality of compressors to the reheat heat exchanger; and a reheat heat exchanger configured to transfer heat to the portion of the first compressed refrigerant from supply air provided to a conditioned space of the HVAC system to warm the supply air, wherein the control panel is configured to sequence operation of the first and second pluralities of compressors in the clustered mode when the input indicates that dehumidification of the supply air is requested, and wherein the control panel is configured to sequence operation of the first and second pluralities of compressors in the balanced mode when the input indicates that only cooling of the supply air is requested.

3. The multi-circuit refrigeration system of claim 2, wherein the reheat circuit is configured to direct the portion of the first compressed refrigerant from only one compressor of the first plurality of compressors to the reheat heat exchanger.

4. The multi-circuit refrigeration system of claim 2, wherein the reheat circuit is configured to direct the portion of the first compressed refrigerant from each compressor of the first plurality of compressors to the reheat heat exchanger.

5. The multi-circuit refrigeration system of claim 1, wherein the input comprises: a desired temperature of a space to be conditioned, a current temperature of the space to be conditioned, a desired humidity of the space to be conditioned, a current humidity of the space to be conditioned, or any combination thereof.

6. The multi-circuit refrigeration system of claim 1, wherein the control panel is configured to change between the balanced mode and the clustered mode of sequencing operation of the first plurality of compressors and the second plurality of compressors during operation of the multi-circuit refrigeration system.

7. The multi-circuit refrigeration system of claim 6, wherein the control panel is configured to change between the balanced mode and the clustered mode of sequencing operation by changing from the balanced mode to the clustered mode or by changing from the clustered mode to the balanced mode, and wherein the control panel is configured to energize the compressors according to the new sequence of operation via a smooth transition mode or a rapid transition mode.

8. The multi-circuit refrigeration system of claim 7, wherein the control panel is configured to be operated between the smooth transition mode or the rapid transition mode, wherein, in the smooth transition mode, the control panel is configured to energize or shut down compressors only when the input indicates that a change to dehumidification, cooling, or a combination thereof is requested.

9. The multi-circuit refrigeration system of claim 7, wherein the control panel is configured to be operated between the smooth transition mode or the rapid transition mode, wherein in the rapid transition mode, the control panel is configured to energize or shut down compressors according to the new sequence of operation within a time threshold after the new sequence of operation is generated.

10. The multi-circuit refrigeration system of claim 9, wherein the time threshold is based at least in part on a minimum operational run time of each compressor of the first and second pluralities of compressors, wherein each compressor operates for the minimum operational run time to ensure the compressor reaches steady state.

11. The multi-circuit refrigeration system of claim 1, wherein each compressor of the first and second plurality of compressors has the same capacity.

12. The multi-circuit refrigeration system of claim 1, wherein the control panel is configured to generate the sequence of operation based on a start count of each compressor of the first and second pluralities of compressors, an operational run time of each compressor of the first and second pluralities of compressors, a status of each compressor of the first and second pluralities of compressors, a capacity of each compressor of the first and second pluralities of compressors, or a combination thereof, wherein the start count of each compressor is indicative of how many times the respective compressor has been energized, and wherein the operational run time of each compressor is indicative of how long the respective compressor has been energized.

13. The multi-circuit refrigeration system of claim 1, wherein each compressor of the first plurality and the second plurality of compressors is sequenced for operation to generate a comprehensive sequence of compressors, wherein the comprehensive sequence provides an order by which each compressor of the first plurality and the second plurality of compressors is selectively energized based on the input, and wherein the control panel selectively energizes compressors according to the comprehensive sequence.

14. One or more tangible, non-transitory machine-readable media comprising processor-executable instructions to:

receive one or more inputs related to humidity from a humidity sensor or humidistat; and based on the input, sequence operation of a first plurality of compressors of a first refrigeration circuit and a second plurality of compressors of a second refrigeration circuit between a balanced mode and a clustered mode, wherein, in the balanced mode, a first compressor of the first plurality of compressors and a first compressor of second plurality of compressors are energized before a second compressor of the first plurality of compressors or a second compressor of the second plurality of compressors is energized, and wherein, in the clustered mode, the first compressor and the second compressor of the first plurality of compressors are energized before the first compressor or the second compressor of the second plurality of compressors is energized.

15. The tangible, non-transitory machine-readable media of claim 14, wherein the processor-executable instructions are configured to switch between the clustered mode and the balanced mode based on the input, and wherein the switch between the clustered mode and the balanced mode is made via a smooth transition mode or a rapid transition mode.

16. The tangible, non-transitory machine-readable media of claim 14, wherein the processor-executable instructions are configured to sequence operation of the first plurality of compressors and the second plurality of compressors in the clustered mode when the input indicates dehumidification is requested or indicates dehumidification and cooling are requested, and wherein the processor-executable instructions are configured to sequence operation of the first plurality of compressors and the second plurality of compressors in the balanced mode when the input indicates only cooling is requested.

17. The tangible, non-transitory machine-readable media of claim 14, wherein the processor-executable instructions are configured to sequence compressors based on compressor operation parameters comprising compressor start count, compressor operational run time, compressor status, compressor capacity, or any combination thereof.

18. The tangible, non-transitory machine-readable media of claim 14, wherein the first refrigeration circuit and the second refrigeration circuit are thermally independent, do not share an interlaced coil, or any combination thereof.

19. The tangible, non-transitory machine-readable media of claim 14, wherein the one or more inputs comprises a desired temperature of a space to be conditioned, a current temperature of the space to be conditioned, a desired humidity of the space to be conditioned, a current humidity of the space to be conditioned, or any combination thereof.

* * * * *